US005415247A

United States Patent [19]

Knorr

[11] Patent Number: 5,415,247

[45] Date of Patent: May 16, 1995

[54] AUTOMOTIVE FLUID EXCHANGE SYSTEM

[76] Inventor: Robert Knorr, RR 1 Box 1112C, Pennellville, N.Y. 13132

[21] Appl. No.: 246,775

[22] Filed: May 20, 1994

[51] Int. Cl.[6] ..... F16C 3/14

[52] U.S. Cl. ..... 184/1.5; 141/98; 141/65

[58] Field of Search ..... 184/1.5; 123/196 R; 141/98, 65, 67, 285

[56] References Cited

U.S. PATENT DOCUMENTS

| | | | |
|---|---|---|---|
| 4,095,673 | 6/1978 | Takeuchi | 184/65 |
| 4,296,838 | 10/1981 | Cohen | 184/106 |
| 4,386,637 | 6/1983 | Buchanan et al. | 141/65 |
| 4,807,674 | 2/1989 | Sweet | 141/59 |
| 4,909,205 | 3/1990 | Bewley | 123/196 |
| 4,938,315 | 7/1990 | Ohta et al. | 184/1.5 |
| 4,949,765 | 8/1990 | Creeron | 141/65 |
| 4,964,373 | 10/1990 | Bedi | 123/196 |
| 5,044,334 | 9/1991 | Bedi | 132/196 |
| 5,056,621 | 10/1991 | Trevino | 184/1.5 |
| 5,242,032 | 9/1993 | Prestwood et al. | 184/1.5 |
| 5,318,080 | 6/1994 | Viken | 141/98 |

FOREIGN PATENT DOCUMENTS

| | | | |
|---|---|---|---|
| 519444 | 12/1955 | Canada | 184/1.5 |
| 2252462 | 5/1974 | Germany | 184/1.5 |

*Primary Examiner*—Thomas E. Denion
*Attorney, Agent, or Firm*—George R. McGuire

[57] ABSTRACT

An automotive fluid exchange system wherein new fluid (such as power steering fluid) is simultaneously exchanged with the used fluid. First and second fluid conduits having first and second pumps disposed therein, respectively, provide the passageway between an engine compartment and a container for the new and used fluid, respectively. The two pumps are selectively actuable by a respective, conventional toggle switch. Conventional jumper cables provide the power supply means to drive the pumps.

12 Claims, 2 Drawing Sheets

AUTOMOTIVE FLUID EXCHANGE SYSTEM

BACKGROUND OF THE INVENTION

1. Field of Invention

The present invention relates to an improved method and apparatus for simultaneously exchanging various automotive fluids, particularly power steering fluid. Moreover, the present invention relates to apparatus which permits automatic, simultaneous exchange of automotive fluids.

2. Introduction

It is well known that to keep an automobile running well it is necessary to perform routine maintenance, particularly changing the fluids which provide cleansing and lubrication to the many movable parts of the car's engine. Traditionally, to change any of these fluids it was necessary to either have the car lifted off the ground or climb underneath the car in order to reach the necessary points in the engine compartment for the particular fluid involved. The fluid could then be drained into a suitable receptacle and the engine compartment could be resealed. New fluid could then be manually poured into the appropriate engine compartment.

The above-described, traditional process of changing automotive fluids may be feasible, but it is also time consuming, messy and with the onset of certain environmental regulations, possibly illegal depending on the composition of the fluid being changed. Furthermore, many people do not have the tools, skill or knowledge necessary to climb under a car and know which drain plugs to pull, among other things.

Consequently, many automatic fluid change systems have become well known in the art. Such automatic devices permit old fluid to be siphoned out of the car through a tube and then replaced with new fluid being pumped through the same tube into the car's appropriate engine compartment. Such systems may utilize electrical motors and pumps, such as the one disclosed in U.S. Pat. Nos. 5,056,621 issued to Trevino, 4,964,373 to Bedi, or 5,044,334 also to Bedi. Other devices may include apparatus intended to be actuated through creating a vacuum by gravitational siphoning such as the one disclosed in U.S. Pat. No. 4,807,674 issued to Sweet.

While each of the above-identified patents describe more sophisticated fluid changing systems than the traditional method also described above, the amount of time necessary to properly change the fluids has not been significantly decreased since the old fluid first needs to be removed before the new fluid is put into the car. Furthermore, some of the above-described inventions are too complicated for a layman to use.

3. Objects and Advantages

It is therefore a principal object of the present invention to provide an automotive fluid exchange system which permits the simultaneous removal of old fluid and replacement with new fluid.

It is a further object of the present invention to provide an automotive fluid exchange system which is easy and ecologically safe to operate.

It is an additional object of the present invention to provide an automotive fluid exchange system which is inexpensive to manufacture.

Other objects and advantages will in part be obvious and in part appear hereinafter.

SUMMARY OF THE INVENTION

In accordance with the foregoing objects and advantages, the present invention provides an effective and efficient device for simultaneously exchanging old automotive fluid with new fluid. While the present invention is intended to be used primarily to change power steering fluid, it also may be applied to change other automotive fluids as well.

The present automotive fluid changing device is essentially comprised of a fresh fluid delivery conduit, a used fluid drainage conduit and two pumps, one extending respectively through the two conduits. Each of the conduits include respective first and second ends which extend in fluid communication between a fluid receptacle and the particular engine compartment that is being maintained. The first end of one of used fluid drainage conduit is intended to be positioned near the bottom of the engine compartment for the purpose of removing the maximum amount of fluid from the compartment as possible. The second end of that conduit is positioned within an empty receptacle for the obvious purpose of collecting the used fluid in an ecologically correct manner. The first end of the fluid delivery conduit is positioned within the particular engine compartment at a distance slightly above the meniscus of the fluid when the compartment is full. The second end of this conduit is positioned near the bottom of a receptacle which is holding new fluid, thus permitting the maximum amount of new fluid to be automatically taken from the receptacle. Each of the two conduits is comprised of several flexible tubes.

As previously mentioned, fluid is driven through the conduits by means of respective pumps. The pumps are each selectively actuable due to their electrical connections to a respective, conventional, single pole, single throw switch. The DC power supply means for driving the motors of the pumps is provided through conventional jumper cables which may be operably attached to the car's battery.

Accordingly, to operate the fluid exchange system of the present invention it is first necessary to attach the jumper cables to the battery of a car. After turning the car on and removing the necessary caps from the engine compartment, the conduits can be positioned appropriately within the engine compartment and their respective receptacles. The two switches should then be moved to their "on" positions for a predetermined amount of time which is sufficient to prime both pumps (i.e., fill each conduit with fluid). The car may then be shut off to readjust the conduits and ensure there are no obstructions impeding the ultimate exchanging of fluids. In exchanging power steering fluid it is necessary to lock the steering wheel all the way to the right by using a strap to hold the steering wheel in its locked position and therefore completely opening up the power steering fluid lines. The pumps may then be turned back on and let to run until all the old fluid is removed and all the new fluid is in the engine compartment. Once all the old fluid is removed and the new fluid delivered, bubbles will begin to form around the fluid delivery conduit due to the air being forced through the fluid delivery conduit which obviously produces air bubbles in the fluid contained in the engine compartment. The tubes may then be removed from the engine compartment along with the jumper cables from the battery, and the steering wheel may be unlocked.

Ideally the amount of fluid drained will equal the amount of fluid entered into the compartment, thereby filling the compartment with an adequate amount of fluid. However, if the engine compartment still needs more fluid, it may be topped off manually.

BRIEF DESCRIPTION OF THE DRAWINGS

The invention will further be described in connection with the accompanying drawings, wherein.

DETAILED DESCRIPTION

Figure 1:
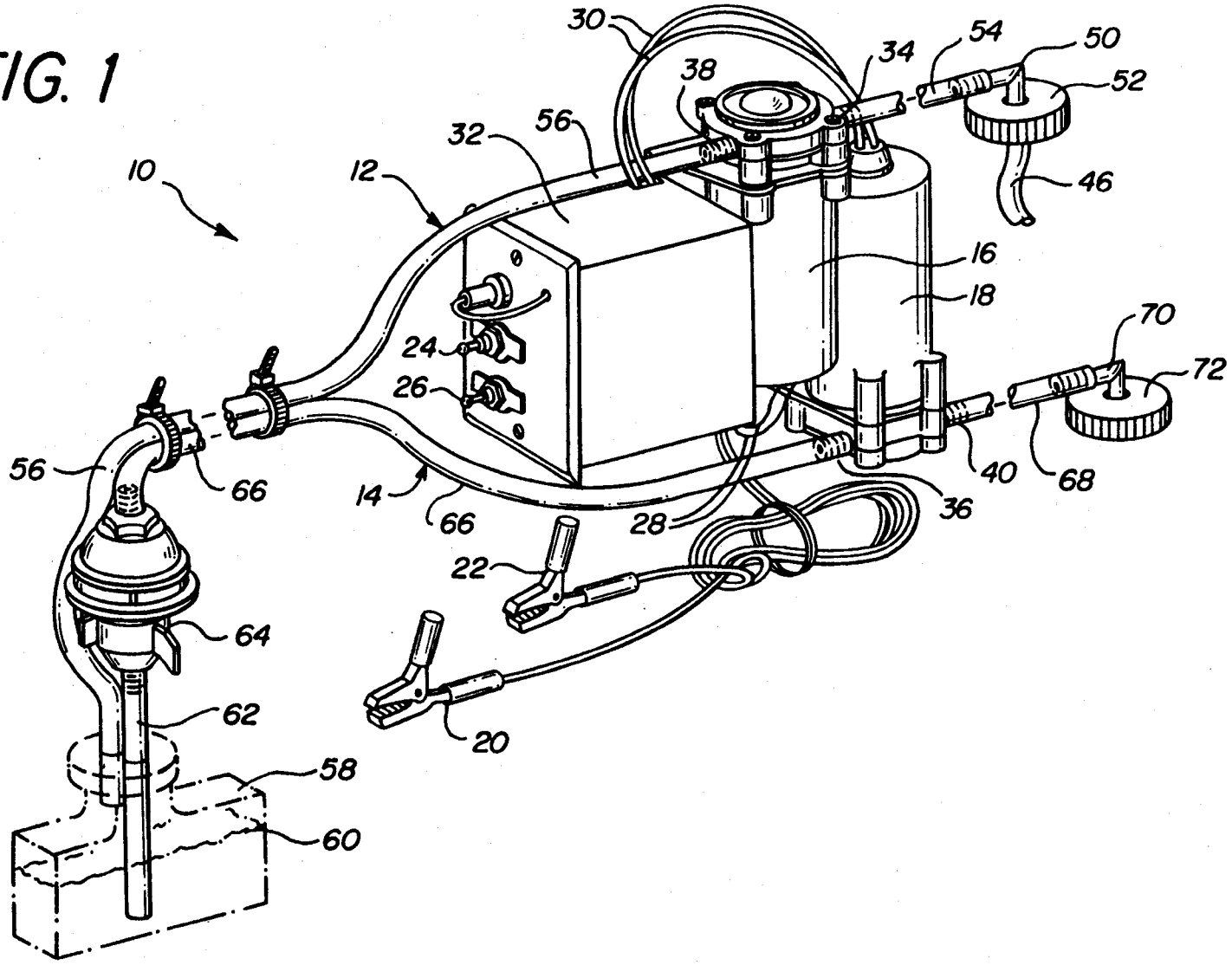
FIG. 1 is a perspective view of an automotive fluid exchange system which embodies the present invention.

Referring now to the drawings wherein like reference numerals refer to like parts throughout, there is seen in FIG. 1 an automotive fluid exchange device denoted generally by reference numeral 10. Although fluid exchange device 10 is principally intended to be used when changing power steering fluid, the disclosure and claims following hereinafter will broadly encompass any automotive fluid.

Fluid exchange device 10 is seen in FIG. 1 to be generally comprised of a first, fresh fluid conduit and a second, used fluid conduit denoted generally by reference numerals 12 and 14, respectively, and first and second pumps 16 and 18 through which first and second conduits 12 and 14 extend, respectively. Pumps 16 and 18 receive power through conventional jumper cables 20 and 22 which are obviously intended to be operably connected to the terminals of a car's battery. Single-pole, single-throw switches 24 and 26 are electrically connected to pumps 16 and 18, respectively, via wire leads 28 and 30, respectively. Switches 24 and 26 provide means for selectively actuating pumps 16 and 18. The electrical contacts of switches 24 and 26 as well as the ground for jumper cables 20 and 22 are all retained within a housing 32.

Figure 2:
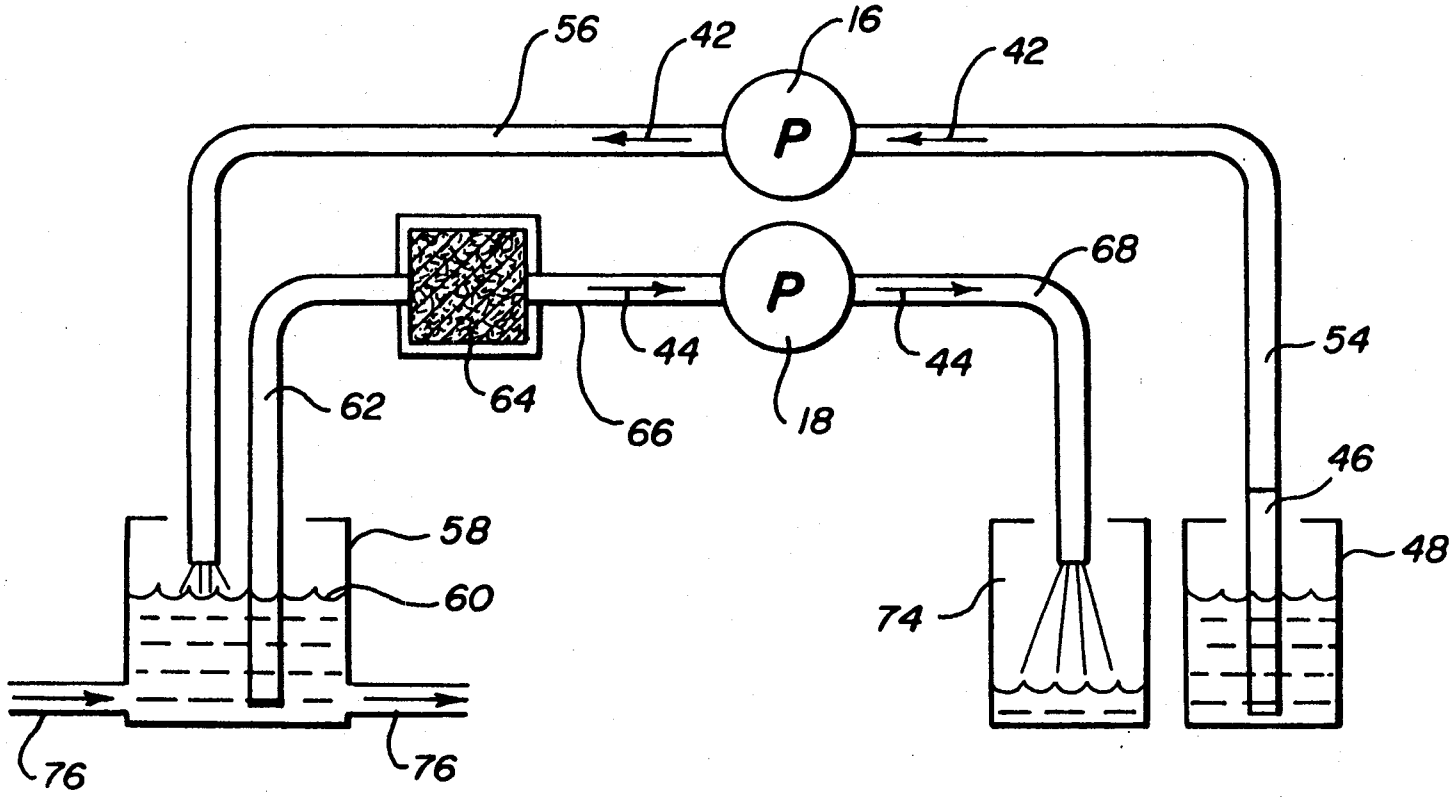
FIG. 2 is a schematic view of the instant invention.

Pumps 16 and 18 are conventional manual demand, open flow pumps such as those manufactured by Shurflo Corp. of California under model number 100-000-21. Pumps 16 and 18 each include suction ports 34 and 36, respectively, and discharge ports 38 and 40, respectively. For purposes of convenience, pumps 16 and 18 are positioned in substantially opposite, longitudinal orientation, thus permitting the fluids pumped through conduits 12 and 14 to flow in opposite directions, as is clearly indicated by arrows 42 and 44 seen in FIG. 2.

Fluid conduits 12 and 14 are each comprised of several varying lengths of flexible, plastic tubing. Fresh fluid conduit 12 is comprised of a first length of tubing 46 which extends between the bottom of a container 48 of fresh automotive fluid and an elbow coupling 50 which extends through a cap 52 which is adapted to seal container 48. It is important that tube 46 extend to the bottom of container 48 for the purpose of automatically removing the maximum amount of fluid. A second length of tubing 54 extends between the opposite end of coupling 50 and suction port 34 of pump 16. A third length of tubing 56 extends between discharge port 38 of pump 16 and engine compartment 58. Tube 56 is intended to only extend into engine compartment 58 to approximately the meniscus of automotive fluid 60 when it's at its highest level. The reasons for this will be explained hereinafter.

Conduit 14 is comprised of a first length of tubing 62 which extends from the bottom of engine compartment 58 to a first end of a filtering unit 64. As the fluid passes through filtering unit 64 any solid particles above a predetermined size which may have accumulated in the fluid are filtered out, thus permitting for ecologically safer disposal of the fluid. A second length of tubing 66 then extends between a second end of filtering unit 64 and suction port 36 of pump 18. Conduit 14 then continues with a bottom of a particular engine compartment (as will be the case if changing the power steering fluid in a car which has a dipstick leading to the power steering pump instead of a capped reservoir), additional lengths of tube may be attached to the free end of tube 62, thus effectively increasing the length of conduit 14. The additional lengths of tube are not shown in the drawings, but they are substantially identical to those tubes which are shown.

To operate fluid exchange system 10 it is first necessary to remove the cap from engine compartment 58. If changing the power steering fluid it is then necessary to lock the steering wheel of the car all the way to the right in order to open a conventional relief valve and keep the power steering fluid lines 76 completely open (see FIG. 2), thus permitting any residual fluid contained in lines 52 to be circulated therethrough. A strap or belt (not shown) can be used to lock the steering wheel in its rightmost position. The ends of tubes 56 and 62 should then be inserted into engine compartment 58 (tube 12 not being submerged into the existing fluid and tube 42 being submerged as deeply as possible into the existing fluid). Cap 52 should then be fastened to fluid filled container 48 with tube 54 extending all the way to the bottom of container 30, and cap 72 fastened to collection receptacle 74. Connect jumper cables 20 and 22 to the respective terminals of the car's battery and turn the car on. Turn switches 24 and 26 to their respective "on" positions for a predetermined length of time which is sufficient to permit pumps 16 and 18 to become fully primed, and then turn switches 24 and 26 to their respective "off" positions. The car can then be turned off and all the wires and tubes should be checked to ensure proper positioning. The car's engine can then be restarted and switches 24 and 26 can be positioned in their respective "on" positions, thus actuating pumps 16 and 18. Pumps 16 and 18 can then be left to run until bubbles begin to form around the end of tube 56 positioned within engine compartment 58, thus indicating that all the old fluid in engine compartment 58 has been replaced by new fluid. The reasons for the bubble formation is that once all the fluid is out of container 48, only air passes through conduit 12, thus causing bubbles to form in the liquid contained in engine compartment 58. Switches 24 and 26 can then be switched to their "off" positions, the car's engine can be turned off, and all connections of fluid exchange device 10 to the car can be disconnected.

If after the automatic pumping of new fluid has been completed engine compartment 58 is still not completely filled to capacity, additional fresh fluid may be manually poured into the compartment.

As previously mentioned fluid exchange device 10 is intended to be used to change power steering fluid, thus in that particular instance engine compartment 58 would be defined as being a power steering fluid reservoir. However, since this patent is intended to encompass a device which is capable of changing any automotive fluid which is routinely changed (i.e. oil, coolant, brake fluid, etc. . . . ), engine compartment 58 should be broadly defined as being the particular compartment which is accessed when changing any of the normally changed fluids in an automobile.

What is claimed is:

1. An automotive fluid exchange system for simultaneously removing from an enclosed compartment having an upper wall with an access opening therein and a lower wall used fluid initially filling said compartment to a predetermined level and replacing said used fluid with fresh fluid, said used fluid being deposited in a first container and said fresh fluid being taken from a second container, said system comprising:

a) first conduit means extending through said access opening from a first end positioned within said compartment adjacent said lower wall to a second end positioned within said first container;

b) second conduit means extending through said access opening from a first end positioned within said compartment substantially at said predetermined level to a second end positioned within said second container below the level of said fresh fluid therein;

c) first pump means operable to transport said used fluid through said first conduit means from said compartment to said first container;

d) second pump means operable to transport said fresh fluid through said second conduit means from said second container to said compartment; and e) power supply means actuable to simultaneously operate said first and second pump means.

2. The invention according to claim 1 and further comprising switch means for selective actuation of said first and second pump means.

3. The invention according to claim 2 wherein said switch means includes first and second independently actuable single-pole, single-throw switches electrically connected to said first and second pump means, respectively.

4. The invention according to claim 1 wherein said power supply means includes a positive and negative jumper cable for respective connection to positive and negative battery terminals.

5. The invention according to claim 1 and further including a filtering unit disposed in said first conduit means.

6. The invention according to claim 1 wherein said first and second pump means are selectively actuated, open flow pumps.

7. A method of replacing used automotive fluid initially filling a compartment having an upper access opening to a predetermined level with a fresh fluid, said method comprising:

a) positioning one end of a first, elongated conduit means within said compartment substantially at said predetermined level;

b) extending said first conduit through said access opening and positioning the other end of said first conduit in a first container below the level of fresh fluid within said first container;

c) connecting in said first conduit, intermediate of said one and said other ends thereof, first pump means selectively operable to cause said fresh fluid to flow through said first conduit from said first container to said compartment;

d) positioning one end of a second, elongated, conduit means within said compartment at a level near the bottom of said used fluid;

e) extending said second conduit through said access opening and positioning the other end of said second conduit in a second container;

f) connecting in said second conduit, intermediate of said one and said other ends thereof, second pump means selectively operable to cause said used fluid to flow through said second conduit from said compartment to said second container;

g) simultaneously operating each of said first and second pump means at substantially the same flow rate until said used fluid has been removed from said compartment and replaced by said fresh fluid.

8. The method of claim 7 wherein said first and second pump means are electrically powered, and said step of operating said pump means includes selective actuation of switch means interposed in an electric line extending between a source of electrical power and said pump means.

9. The method of claim 8 wherein said first and second pump means are each powered by DC motors, and further including attaching said electric line to positive and negative terminals of an automotive battery.

10. The method of claim 7 wherein said other end of said first conduit is positioned at a level within said first container such that the volume of fresh fluid above that level is substantially equal to the volume required to replace said used fluid.

11. The method of claim 10 and further including visually observing said one end of said first conduit and stopping operation of said first and second pump means upon observation of the presence of bubbles adjacent said first end of said first conduit, indicating that all of said required volume of fresh fluid has been removed from said first container.

12. The method of claim 11 wherein said fluid is power steering fluid and further including placing the steering wheel of the vehicle which includes said compartment in a position wherein the power steering liner are fully open.

* * * * *